US007404469B2

(12) United States Patent
Takeuchi

(10) Patent No.: US 7,404,469 B2
(45) Date of Patent: Jul. 29, 2008

(54) ELEVATOR CALL REGISTRATION DEVICE

(75) Inventor: Nobukazu Takeuchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 541 days.

(21) Appl. No.: 10/544,392

(22) PCT Filed: Feb. 13, 2004

(86) PCT No.: PCT/JP2004/001570

§ 371 (c)(1),
(2), (4) Date: Aug. 3, 2005

(87) PCT Pub. No.: WO2005/077803

PCT Pub. Date: Aug. 25, 2005

(65) Prior Publication Data

US 2006/0225964 A1 Oct. 12, 2006

(51) Int. Cl.
*B66B 1/34* (2006.01)

(52) U.S. Cl. ..... 187/391; 187/380; 187/396

(58) Field of Classification Search ..... 187/380–388, 187/391–399

See application file for complete search history.

(56) References Cited

U.S. PATENT DOCUMENTS

| | | | | |
|---|---|---|---|---|
| 4,852,696 | A * | 8/1989 | Fukuda et al. | 187/392 |
| 6,394,231 | B1 * | 5/2002 | Schuster et al. | 187/382 |
| 7,021,428 | B2 * | 4/2006 | Han et al. | 187/395 |
| 7,021,429 | B2 * | 4/2006 | Hikita | 187/398 |
| 7,036,635 | B2 * | 5/2006 | Rintala et al. | 187/396 |
| 7,040,458 | B2 * | 5/2006 | Forsythe et al. | 187/396 |
| 2001/0035314 | A1 * | 11/2001 | Yoshida et al. | 187/382 |

FOREIGN PATENT DOCUMENTS

| | | | |
|---|---|---|---|
| GB | 2241090 | A * | 8/1991 |
| JP | 58-31876 | A | 2/1983 |
| JP | 4-173670 | A | 6/1992 |
| JP | 6-191753 | A | 7/1994 |
| JP | 8-59108 | A | 3/1996 |
| JP | 8-175770 | A | 7/1996 |
| JP | 2001-233556 | A | 8/2001 |
| JP | 2001-302128 | A | 10/2001 |

* cited by examiner

*Primary Examiner*—Jonathan Salata
(74) *Attorney, Agent, or Firm*—Sughrue Mion, PLLC

(57) ABSTRACT

An elevator call registration device selectively switches between display of an operation screen for allowing a user to designate a registration for moving a car to an arbitrary destination floor from among a plurality of destination floors and display of a registered-floor screen for displaying the destination floor that is designated through operation on the operation screen and registered with an elevator control device.

3 Claims, 4 Drawing Sheets

ELEVATOR CALL REGISTRATION DEVICE

TECHNICAL FIELD

The present invention relates to an elevator call registration device that performs a control for registering an elevator car to a destination floor.

BACKGROUND ART

In conventional display input switching systems, as described in, for example, JP 2001-302128 A, a destination floor screen is displayed for requesting a registration for moving a car to predetermined destination floors according to the number of elevator passengers.

In this regard, however, the destination floor screen simultaneously displays a ten-key for designating predetermined destination floors and a listing of the destination floors registered through operation of the ten-key, that is, a listing of the registered floors, with the result that the total number of registered floors to be displayed is limited depending on how much of the screen space can be allocated for display of the registered floors included in the listing.

In view of this, the present invention is made to overcome the inconvenience described above, and therefore it is an object of the invention to provide an elevator call registration device that enables display of a larger number of registration floors.

DISCLOSURE OF THE INVENTION

According to one aspect of the present invention, there is provided an elevator call registration device comprising: a display portion that displays an operation screen for allowing a user to designate a registration for moving a car to an arbitrary destination floor from among a plurality of destination floors, and a registered-floor screen for displaying the destination floor that is designated through operation on the operation screen and registered with an elevator control device; and a processing portion for effecting display of one of the operation screen and the registered-floor screen on the display portion by selectively switching between the operation screen and the registered-floor screen.

BEST MODE FOR CARRYING OUT THE INVENTION

Figure 1:
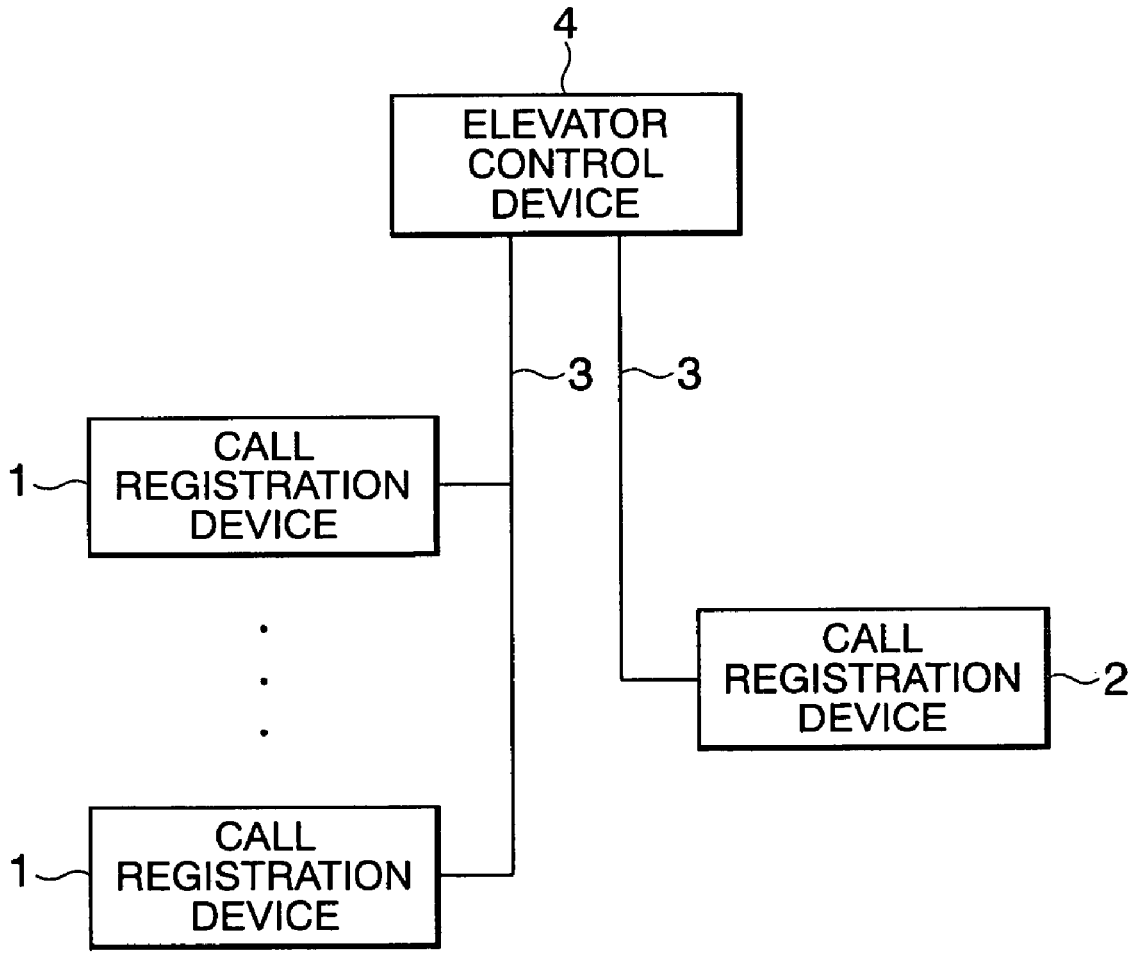
FIG. 1 is a schematic diagram showing an elevator system according to an embodiment of the present invention.

FIG. 1 is a schematic diagram showing an elevator system according to an embodiment of the present invention.

Referring to FIG. 1, a plurality of call registration devices 1, 2 are connected to an elevator control device via transmission lines 3. Each call registration device 1 is provided at the landing of each floor, and the call registration device 2 is provided inside a car.

Each of those call registration devices 1, 2 effects with respect to the elevator control device 4 a registration for moving the car to a predetermined destination floor according to a request from a passenger or the like at the landing.

The elevator control device 4 performs a control for moving the car to the destination floor designated with each call registration device 1, 2.

Figure 2:
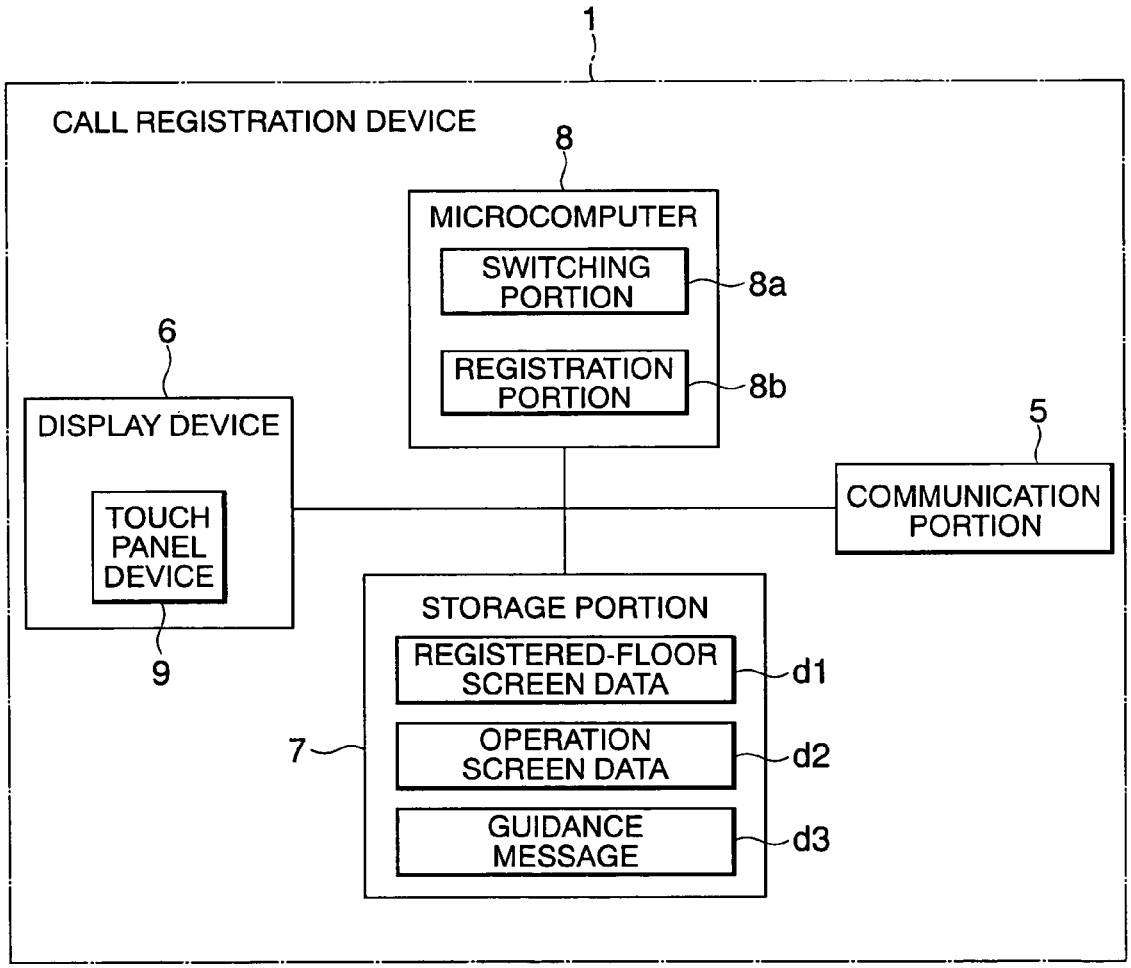
FIG. 2 is a block diagram showing the configuration of a call registration device of FIG. 1.

FIG. 2 is a block diagram showing the configuration of the call registration device 1. It is to be noted that the call registration device 2 has the same configuration as the call registration device 1.

Referring to FIG. 2, the call registration device 1 includes a communication portion 5, a display device (display portion) 6, a storage portion 7, and a microcomputer (processing portion) 8.

The communication portion 5 is composed of, for example, an input/output interface. The communication portion 5 realizes data transmission and reception between each call registration device 1 and the elevator control device 4.

A touch panel device 9 is mounted to the communication portion 6. A control circuit for controlling information is incorporated in each of the display device 6 and the touch panel device 9. In the touch panel device 9, the control circuit detects coordinates on the touch panel, thereby detecting a detection location.

The storage portion 7 is composed of, for example, a memory or hard disk. Registered-floor screen data d1, operation screen data d2, and guidance message d3 are stored in the storage portion 7.

The registered-floor screen data d1 refers to data for displaying destination floors registered with the elevator control device 4 (hereinafter, referred to as the "registered floors"). The registered floors that reflect the latest car operation status in the elevator control device 4 are set in the registered-floor screen data d1.

The operation screen data d2 refers to data for allowing the user to designate a registration for moving the car to an arbitrary destination floor from among the plurality of destination floors. Herein, the operation screen data d2 is set so as to allow designation of a destination floor through operation of a ten-key S1.

The guidance message d3 refers to messages directed to the user. Herein, messages such as "Touch the screen", "Input the destination floor", and the like are included in the guidance message d3.

The microcomputer 8 is composed of, for example, a CPU or the like. The microcomputer 8 includes a switching portion 8*a* and a registration portion 8*b*. The operations of the respective portions 8*a*, 8*b* are as follows. The switching portion 8*a* selectively switches between the registered-floor screen data d1 and the operation screen data d2 for display on the display device 6. The registration portion 9*b* effects registration of a predetermined destination floor with respect to the elevator control device 4. It is to be noted that the microcomputer 8 operates according to a program in the storage portion 7.

Figure 3:
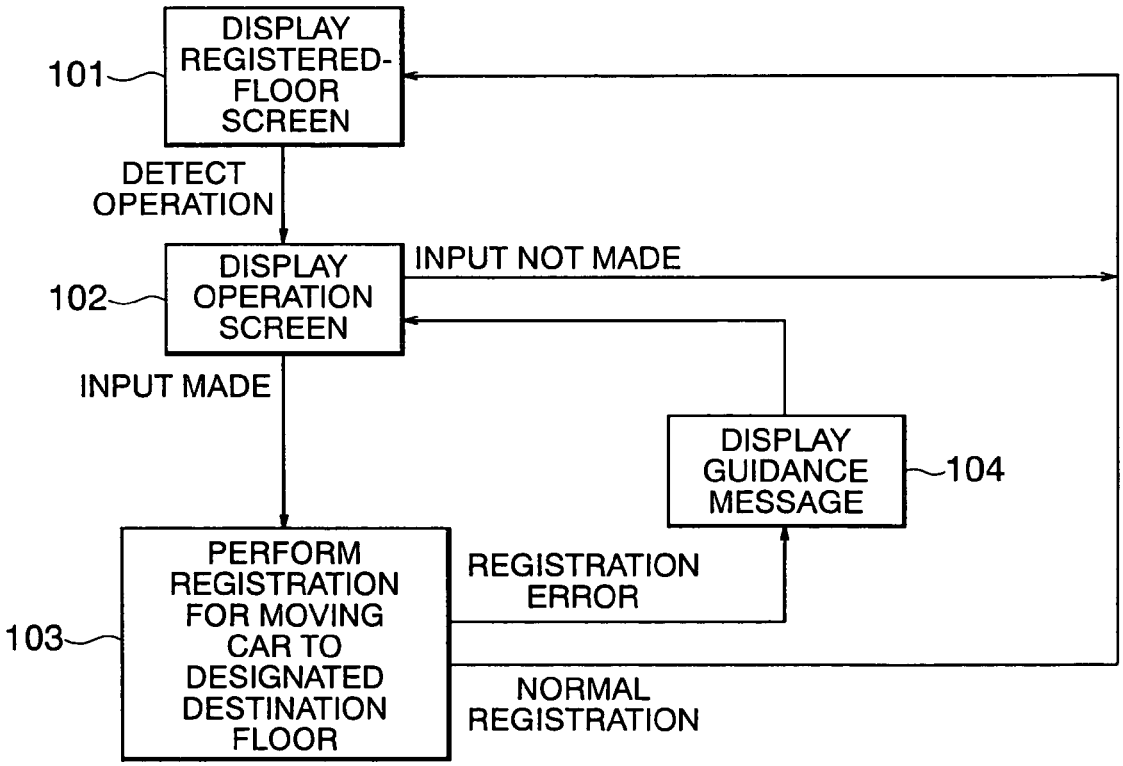
FIG. 3 is an explanatory diagram illustrating how the call registration device of FIG. 1 operates.

FIG. 3 is an explanatory diagram showing how the call registration device 1 operates. Herein, the description is directed to an example in which a passenger waiting at a landing uses the call registration device 1 at the third floor. It is to be noted that the same applies to other call registration devices 1, 2.

First, the switching portion 8*a* of the call registration device 1 references the registered-floor screen data d1 stored in the storage portion 7 and displays a registered-floor screen S2 on the display device 6 (101).

Figure 4:
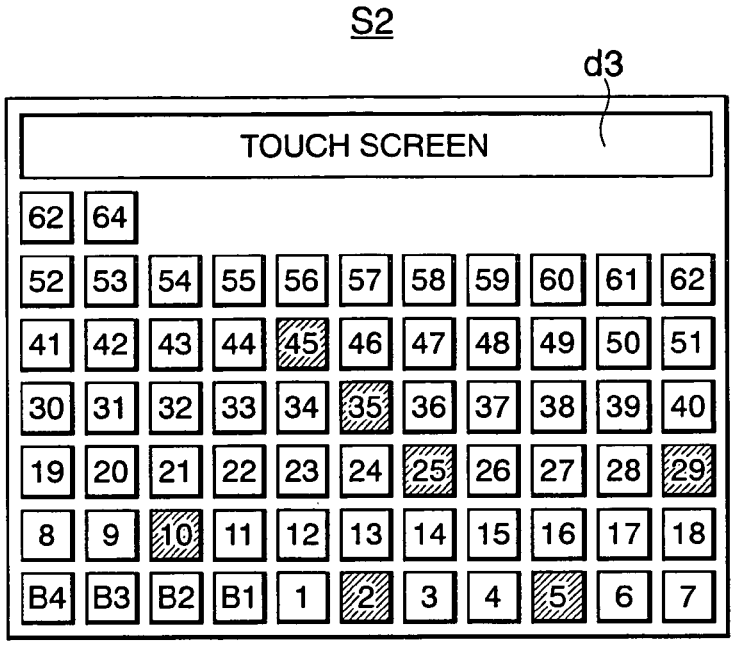
FIG. 4 is an explanatory view showing a registered-floor screen of a display device of FIG. 1.

The registered-floor screen S2 on the display device 6 is shown in FIG. 4. The registered-floor screen S2 displays a listing of all the floors (from the fourth basement floor to the sixty-fourth floor). Further, floors in a different color from others, that is, the registered-floors (e.g. the second floor and the like) are displayed in the all-floors listing on the registered-floor screen S2. Referring to FIG. 4, the floors indicated by the diagonal lines represent the registered floors. Further, the registered-floors are displayed in a red color that is different from the color (e.g. white) in which the floors not indicated by the diagonal lines, that is, the non-registered floors (e.g. the first floor and the like) are displayed.

Further, on the registered-floor screen S2, the guidance message d3 "Touch the screen" is displayed to the user. It is to be noted that the guide messaged 3 is displayed on the registered-floor screen S1 at preset time intervals.

When the user touches the registered-floor screen S2, the touch panel device 9 detects operation on the registered-floor screen S2. Then, the switching portion 8*a* references the operation screen data d2 in the storage portion 7 and switches the registered-floor screen S2 on the display device 6 to an operation screen S3 (102).

Figure 5:
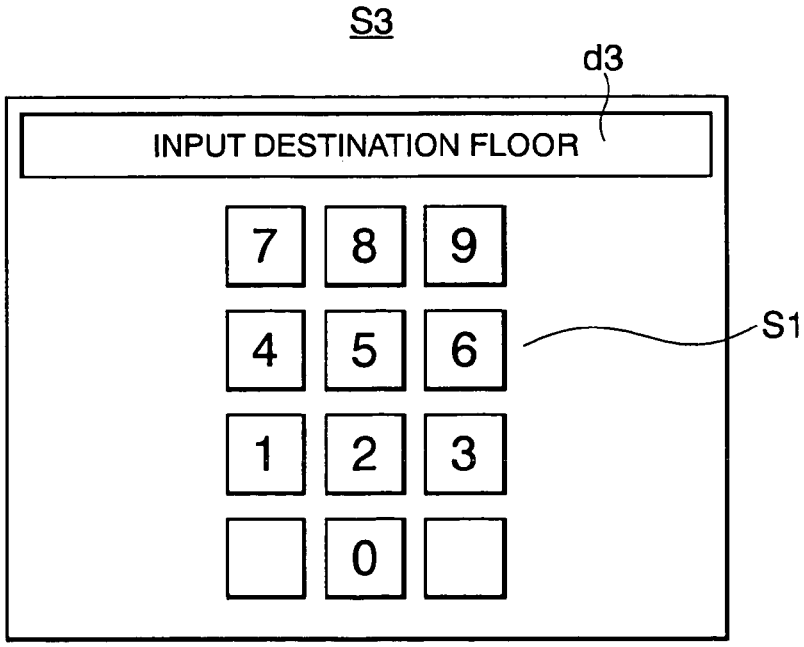
FIG. 5 is an explanatory view showing an operation screen of the display device of FIG. 1.

The operation screen S3 on the display device 6 is shown in FIG. 5. The guidance message d3 "Input the destination floor" is displayed on the operation screen S3. Further, the ten-key S1 is displayed on the operation screen S3.

When the user does not make designation of a predetermined destination floor by operating the ten-key S1 within a set time period (e.g. five second), the switching portion 8*a* references the storage portion 7 and switches the operation screen S3 on the display device 6 to the registered-floor screen S2 (101).

In contrast, when the user designates a desired destination floor (e.g. the thirtieth floor) by operating the ten-key S1 within the set time period, the registration portion 8*b* effects with respect to the elevator control device 4 a registration for moving the car to the destination floor designated through the operation of the ten-key S1 (103).

Then, the elevator control device 4 judges whether or not the registration for moving the car to the designated destination floor has been successfully made.

When the registration for moving the car to the destination floor has not been registered with the elevator control device 4 due to erroneous operations of the ten-key S1 or the like, the registration portion 8*b* receives registration error information from the elevator control device 4 via the transmission line 3. Then, the switching portion 8*a* displays the registration error information on the display device 6 as the guidance message d3 (104), thereby urging the user to make an input again.

When, in contrast, the registration for moving the car to the designated destination floor has been registered with the elevator control device 4, the registration portion 8*b* receives from the elevator control device 4 a notification to the effect that the registration is complete. Then, the switching portion 8*a* references the registered-floor screen data d1 in the storage portion 7 and displays on the display device 6 the latest registered-floor screen S2 containing a newly registered floor (thirtieth floor) (101). As a result, of the all-floors listing on the latest registered-floor screen S2, the thirtieth floor is displayed in red.

As described above, in the elevator call registration device 1, 2, the microcomputer 8 selectively switches between the operation screen S3 and the registered-floor screen S2, which is designated through operation on the operation screen S3 and displays the destination floors registered with the elevator control device 4, for display on the display device 6.

Accordingly, the registered floors can be displayed by using the entire space of the registered-floor screen S2 that is selectively switched over, whereby a larger number of registered-floors can be displayed on the registered-floor screen S2. Moreover, the registered-floor screen S2 and the operation screen S3 can be switched over for display on a single display device 6.

Further, the operation screen S3 enables designation of a destination floor through operation of the ten-key S1, thereby allowing the user to freely set a desired destination floor. Further, the ten-key S1 can be displayed in an enlarged manner using the entire space of the operation screen S3.

Further, in displaying one of the registered-floor screen S2 and the operation screen S3 on the display device 6, the microcomputer 8 is adapted to also display the guidance message d3 on the display device 6, whereby a novice user who uses the call registration device 1, 2 for the first time can be assisted in operating the call registration device 1, 2.

The invention claimed is:

1. An elevator call registration device comprising:

a display portion that displays an operation screen for allowing a user to designate a registration for moving a car to an arbitrary destination floor from among a plurality of destination floors, and a registered-floor screen for displaying the destination floor that is designated through operation on the operation screen and registered with an elevator control device; and a processing portion for effecting display of one of the operation screen and the registered-floor screen on the display portion by selectively switching between the operation screen and the registered-floor screen.

2. An elevator call registration device according to claim 1, wherein the operation screen allows designation of the arbitrary destination floor through operation of a ten-key.

3. An elevator call registration device according to claim 1, wherein the processing portion also effects display of a guidance message to the user while effecting the display of the one of the operation screen and the register-floor screen on the display portion.

* * * * *